US007051688B2

(12) United States Patent
Lancefield

(10) Patent No.: US 7,051,688 B2
(45) Date of Patent: May 30, 2006

(54) CAMSHAFT PHASE SHIFTING MECHANISM

(75) Inventor: Timothy Mark Lancefield, Shipston on Stour (GB)

(73) Assignee: Mechadyne PLC, Oxfordshire (GB)

( * ) Notice: Subject to any disclaimer, the term of this patent is extended or adjusted under 35 U.S.C. 154(b) by 0 days.

(21) Appl. No.: 10/497,646

(22) PCT Filed: Dec. 4, 2002

(86) PCT No.: PCT/GB02/05464

§ 371 (c)(1),
(2), (4) Date: Jun. 4, 2004

(87) PCT Pub. No.: WO03/048530

PCT Pub. Date: Jun. 12, 2003

(65) Prior Publication Data

US 2005/0103293 A1 May 19, 2005

(30) Foreign Application Priority Data

Dec. 7, 2001 (GB) ..... 0129333.1

(51) Int. Cl.
*F01L 1/34* (2006.01)

(52) U.S. Cl. ..... 123/90.15; 123/90.11; 123/90.12

(58) Field of Classification Search ..... 123/90.15, 123/90.16, 90.17, 90.18, 90.27, 90.31, 90.11, 123/90.12, 90.13
See application file for complete search history.

(56) References Cited

U.S. PATENT DOCUMENTS 4,920,929 A * 5/1990 Bishop ..... 123/41.49
5,056,477 A * 10/1991 Linder et al. ..... 123/90.17
6,439,181 B1 * 8/2002 Fujiwaki et al. ..... 123/90.17

* cited by examiner

*Primary Examiner*—Thomas Denion
*Assistant Examiner*—Ching Chang
(74) *Attorney, Agent, or Firm*—Smith-Hill and Bedell

(57) ABSTRACT

A hydraulic phase shifting mechanism is described for an engine camshaft subjected to torque fluctuations during operation. The mechanism employs a magnetorheological fluid as a hydraulic pressure medium and is controlled by selective application of a magnetic field to vary the flow properties of the magnetorheological fluid.

6 Claims, 3 Drawing Sheets

CAMSHAFT PHASE SHIFTING MECHANISM

CROSS REFERENCE TO RELATED APPLICATION

This is a national stage application filed under 35 USC 371 based on International Application No. PCT/GB2002/005464 filed Dec. 4, 2002, and claims priority under 35 USC 119 of United Kingdom Patent Application No. 0129333.1 filed Dec. 7, 2001.

FIELD OF THE INVENTION

The present invention relates to a phase shifting mechanism for an engine camshaft.

BACKGROUND OF THE INVENTION

Many camshaft phase shifting mechanisms (herein also termed phasers) have been proposed, and are in use, which are actuated hydraulically, often using engine oil. While these phasers have been demonstrated to be effective, they can have a high oil demand, sometimes requiring an auxiliary pump and an associated cost penalty. The presence of large amounts of oil in the engine cylinder head can cause problems with oil drainage and aeration, together with the problems associated with belt contamination in the case of belt driven camshafts.

Furthermore, the use of hydraulic actuation requires a control valve, which can control the oil flow in response to electrical inputs from the engine ECU, and this can have significant cost and packaging implications.

U.S. Pat. No. 5,056,477 discloses a phase shifting mechanism for an engine camshaft that is subjected to torque fluctuations during operation. The mechanism comprises a drive member and a driven member coupled for rotation with one another by means of a closed hydraulic circuit formed of a plurality of variable volume working chambers that are connected to one another in such a manner that the volume of one increases as the volume of another decreases. Flow of fluid between the working chambers, which is controlled by a solenoid valve, causes the phase of the drive member to be shifted relative to the driven member.

SUMMARY OF THE INVENTION

In accordance with its broadest aspect, the present invention provides a hydraulic phase shifting mechanism for an engine camshaft subjected to torque fluctuations during operation, which mechanism includes a closed hydraulic circuit, characterised in that the hydraulic circuit employs a magnetorheological fluid as a hydraulic pressure medium and in that an electromagnet is provided for selectively applying a magnetic field to vary the flow properties of the magnetorheological fluid, in order to control the flow of the pressure medium in the hydraulic circuit.

In accordance with a second aspect of the invention, is there is provided a phase shifting mechanism for an engine camshaft that is subjected to torque fluctuations during operation, the mechanism comprising a drive member and a driven member coupled for rotation with one another by means of a closed hydraulic circuit formed of a plurality of variable volume working chambers that are connected to one another in such a manner that the volume of one increases as the volume of another decreases, flow of fluid between the working chambers causing the phase of the drive member to be shifted relative to the driven member, characterised in that the chambers are filled with a magnetorheological fluid and are connected to one another through passages along which fluid flow is controlled by the selective application of a magnetic field.

Magnetorheological fluids are materials that respond to an applied magnetic field with a change in their properties. They have been utilised in both rotary and linear damping systems to provide a damping system whose damping coefficient can be controlled via the magnetic field applied to the fluid.

Phasers acting on an engine camshaft are always subjected to torque fluctuations on account of the reaction from the springs of the poppet valves. While a valve is being opened by a rising ramp on a cam, the camshaft offers resistance while the force of the valve spring is being overcome whereas when a valve is being allowed to close the valve spring applies a force tending to accelerate the camshaft. The reaction torques can thus be employed to advance and retard the camshaft relative to the crankshaft provided that a phaser is designed to allow relative movement in one sense while inhibiting movement in the other sense.

In a phaser where the drive member, i.e. the member connected for rotation with the crankshaft, is coupled hydraulically to the driven member. i.e. the member connected for rotation with the camshaft, it would be possible to allow movement in one sense but not the other by providing two flow paths between each pair of interconnected working chambers, the two paths containing oppositely biased non-return valves. Such a phaser would however require the application of magnetic fields to control fluid flow along two separate fluid flow paths.

Magnetorheological fluids have a very fast response time in that their flow properties change within milliseconds of application or removal of a magnetic field. In a preferred embodiment of the invention, this attribute is used to advantage in that a single flow path is provided between each pair of interconnected working chambers and an electromagnet is provided to apply to the fluid flowing along the flow path a magnetic field of modulated amplitude, the modulation having a frequency related to the speed of rotation of the camshaft and having a phase dependent upon the sense in which the relative phase of the drive and driven members is to be varied.

Because a single electromagnet can be used to bring about the desired change of phase, it is possible for the electromagnet to be fixed to the engine and to arrange for its magnetic circuit to traverse the fluid path, which must of necessity rotate with the camshaft. The fact that the electromagnet need not rotate with the camshaft makes for a simpler and more robust construction.

It is preferred for the phaser to be of the vane type, i.e. having radial vanes movable in arcuate cavities. In particular, the hydraulic circuit preferably comprises two diametrically opposed arcuate cavities that rotate with one of the drive and driven members, each being divided into two working chambers by a respective one of two radial vanes that rotate with the other of the two members.

BRIEF DESCRIPTION OF THE DRAWINGS

The invention will now be described further, by way of example, with reference to the accompanying drawings, in which.

DETAILED DESCRIPTION OF THE PREFERRED EMBODIMENT

Figure 1:
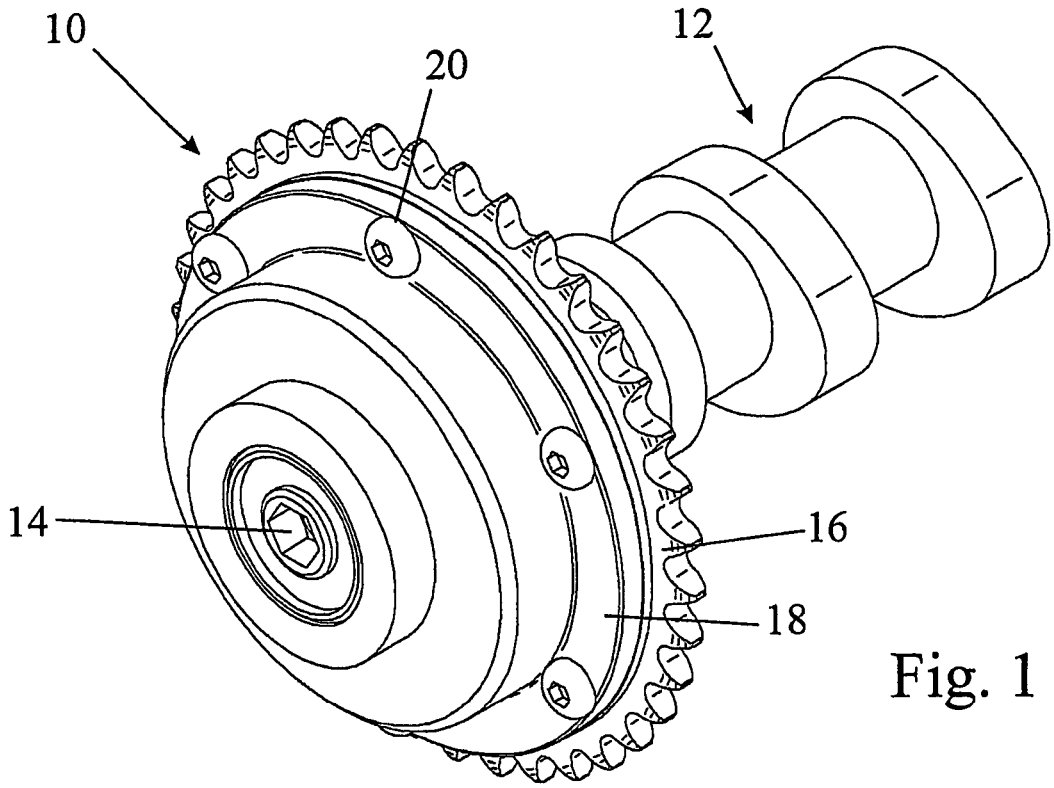
FIG. 1 is a perspective view of an assembled phaser of the invention.
Figure 2:
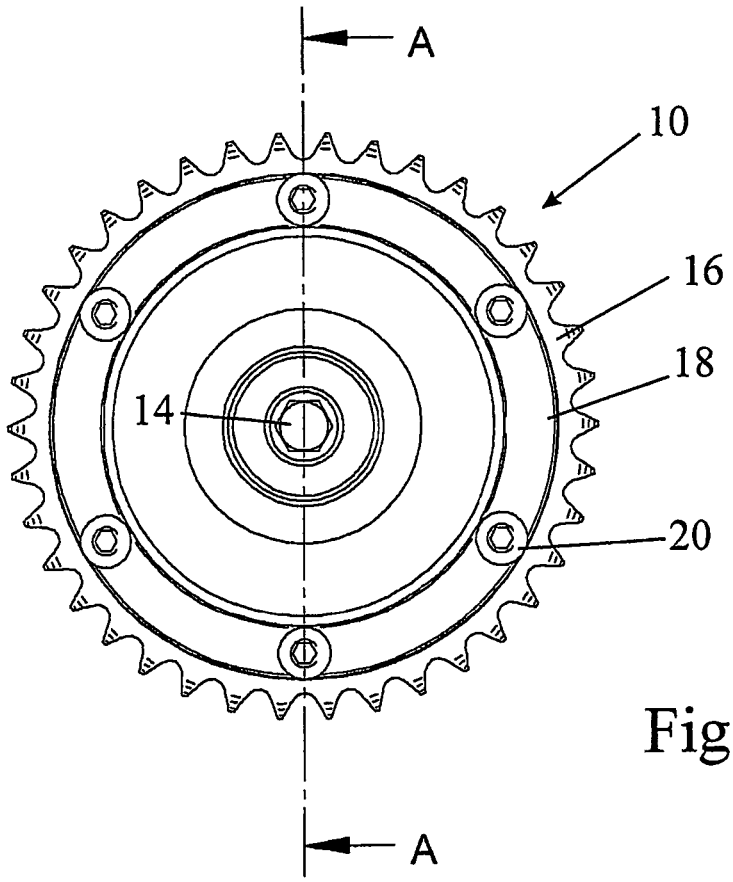
FIG. 2 is a front view of the phaser in FIG. 1.
Figure 3:
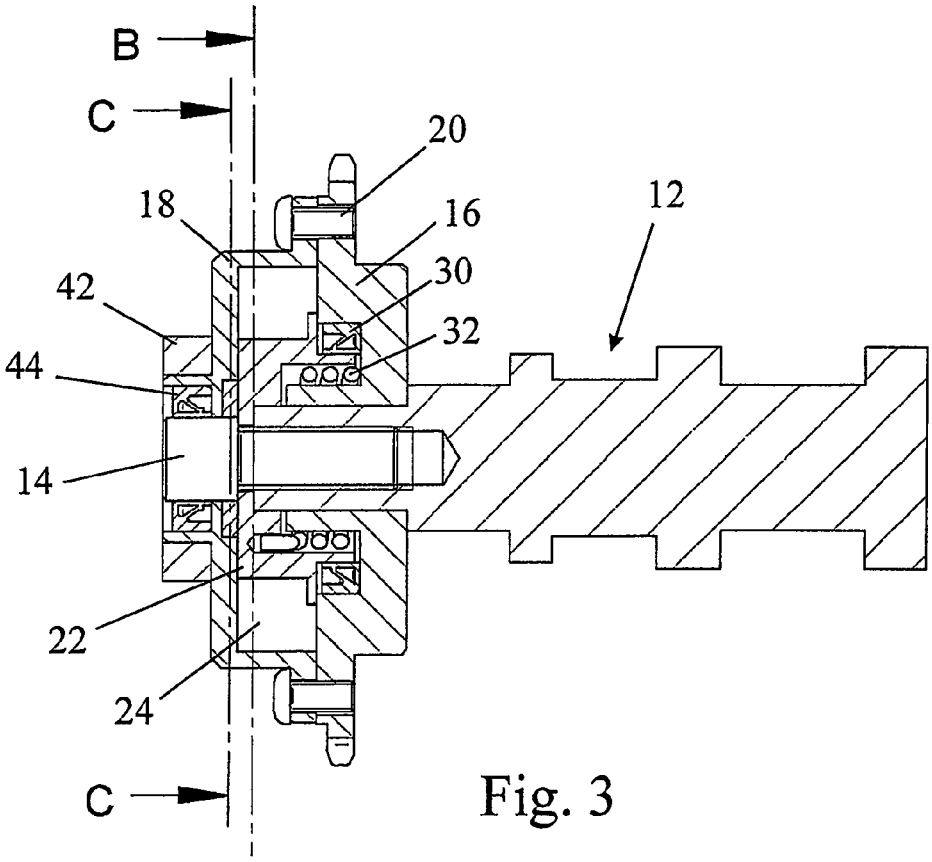
FIG. 3 is a section along the plane A—A in FIG. 2.

The illustrated phaser is similar in construction to the vane-type phasing systems that are often utilised in hydraulically controlled applications. The illustrated embodiment has two vane cavities but it will be appreciated by the person skilled in the art that many other layouts would clearly be possible. The phaser moves under the influence of camshaft torque reversals and hence requires no external source of energy.

The phaser 10 comprises a sealed unit filled with a magnetorheological fluid that is fixed by means of a bolt 14 on to the front end of an engine camshaft 12. The casing of the sealed unit is formed of two parts, namely a sprocket 16 that is driven by the engine crankshaft and a dished cover 18 secured to the sprocket 16 by means of bolts 20.

Figure 4:
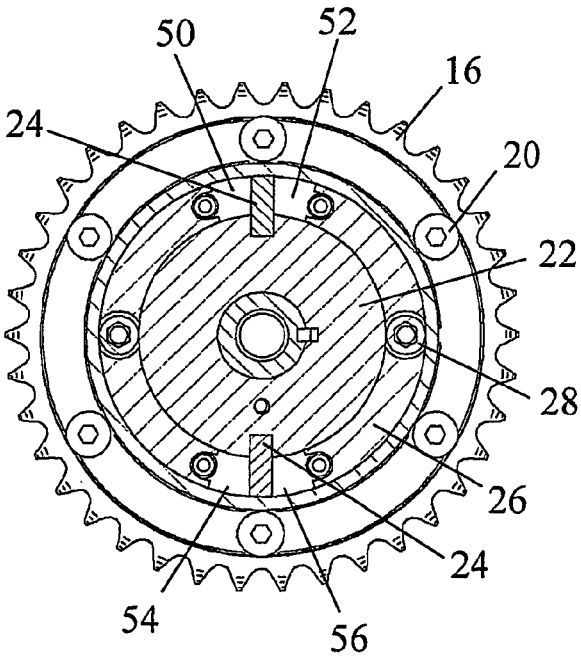
FIG. 4 is a section along the place B—B in FIG. 3.
Figure 5:
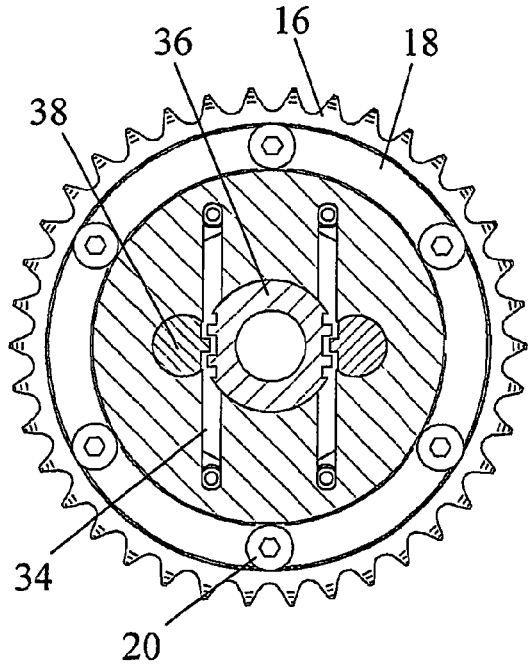
FIG. 5 is a section along the plane C—C in FIG. 3.
Figure 6:
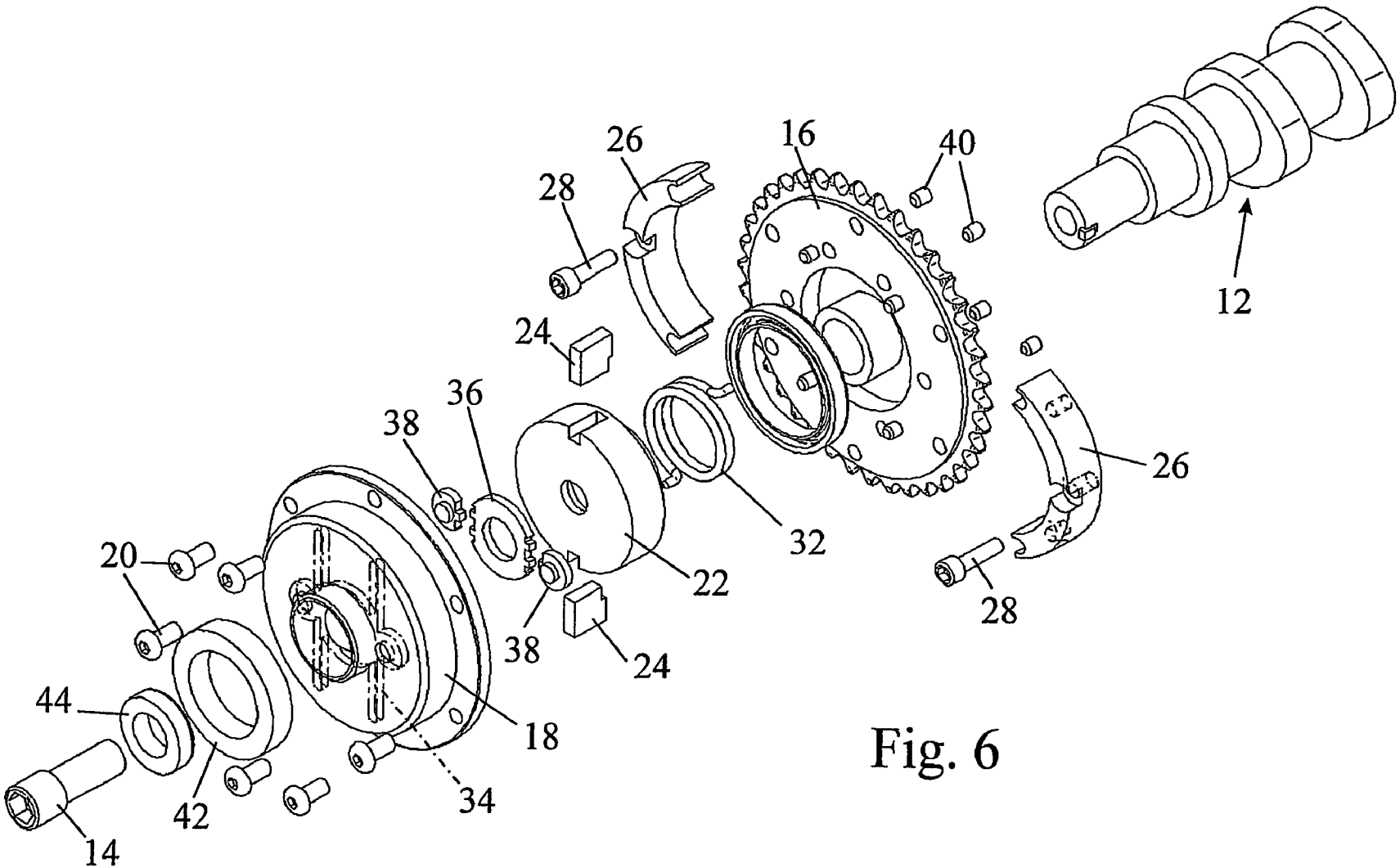
FIG. 6 is an exploded perspective view of the phaser shown in FIG. 2.

The flat cylindrical chamber contained between the sprocket 16 and the cover 18 contains a hub 22 which, as shown in FIG. 4, is keyed to the front end of the camshaft 12. Two vanes 24 are located in radial slots in the hub 22. Two crescent shaped blocks 26 are secured by bolts 28 to the sprocket 16. The inner surfaces of the blocks 26 seal against the cylindrical radially outer surface of the hub 22 and their outer surfaces seal against the outer wall of the chamber defined by the dished cover 18. Between them, the described components define, as best shown in FIG. 4, two arcuate cavities which are divided by the radial vanes 24 into four working chambers designated 50, 52, 54 and 56.

The hub 22 and vanes 24 together form the driven member that rotates with the camshaft, while the remaining components shown in FIG. 4 form part of the drive member that rotates with the engine crankshaft. Rotation of the drive member relative to the driven member is accompanied by a change in the volume of the four working chambers which are connected to one another through passages formed by grooves 34 in the end surface of the cover 18. The working chambers are connected to each other in pairs, the chamber 50 being connected to the chamber 54 and the chamber 52 being connected to the chamber 56. Thus, fluid displaced for example from the chamber 52 during a clockwise movement of the vanes 24, as viewed in FIG. 4, will flow into the chamber 56.

Each of the passages connecting a pair of working chambers includes a labyrinth that is defined between pole pieces 36 and 38. The pole pieces 36, 38 are formed as ferromagnetic inserts that are mounted within the cover 18. The cover 18, the hub 22 and the blocks 26 are all formed of a non-ferromagnetic material, preferably aluminium, in order not to interfere with the magnetic circuit described in more detail below.

The interior of the sealed unit contains a magnetorheological fluid which fills the working chambers 50 to 56. A seal 30 disposed between the hub 22 and the sprocket 16 and a second seal 44 surrounding the bolt 14 prevent the fluid from escaping.

A torque spring 32 acts between the hub 22 and the sprocket 16. The spring 32 acts in the direction to advance the phase of the camshaft 12 relative to the sprocket 16. However, while any valve is being opened by the camshaft 12, it will experience a reaction torque that acts to retard it and overcomes the bias of the spring 32. Thus at different times in the engine cycle the camshaft will experience reversing torques that act alternately in directions to advance and to retard the phase of the camshaft relative to the sprocket 16. If fluid flow is permitted between the working chambers of the hydraulic circuit while a torque is acting, then the phase of the camshaft will change under the action of the torque. If on the other hand fluid flow along the passages 34 is prevented, then the phase of the camshaft will remain unaltered. The spring 32 is sized to ensure that the forces acting to advance and retard the camshaft are substantially equal so that adjustments should occur at the same rate in both directions.

When the magnetorheological fluid is exposed to a magnetic field within the passage 34, it acts as a viscous liquid and because of the tortuous path of the labyrinth between the poles pieces 36 and 38, no flow occurs and the coupling is locked. When the magnetic field is removed on the other hand, the fluid flows freely and permits the camshaft 12 to rotate relative to the sprocket 16. Hence, by the use of a single stationarily mounted electromagnet supplying a magnetic field to the pole pieces 36, 38 it is possible to control the phase.

In particular, when a constant magnetic field is applied, then the hydraulic circuit is locked at all times and no change in phase can occur. If the magnetic field is is energised intermittently with a frequency proportional to the speed of rotation of the crankshaft then depending on the direction of the torque reaction on the camshaft at the time that the magnetic field is switched off, the phase of the camshaft can be advanced or retarded.

The magnetic field is generated by a stationary coil external to the phaser, mounted on the engine chain cover or similar. The magnetic field is generated between a ferrous ring 42 on the front of the phaser that contacts the outer component 38 of both labyrinths, and the central bolt 14, which is ferromagnetic and contacts the shared centre section of both labyrinths.

The person skilled in the art will appreciate that there are a large number of modifications that could be made to the described phaser. The design and number of vanes and cavities could vary significantly from those proposed. Furthermore, it would be possible to design a similar system using hydraulic cylinders to position the camshaft rather than vanes in cavities.

There is an alternative control methodology that could be employed if the connecting passages between the vane cavities were of a different nature. Passages could be designed to connect the vane cavities via a one-way valve that would only allow the fluid to pass in one direction. A second set of passages could be provided allowing fluid to flow in the opposite direction. The camshaft timing could then be controlled by removing the magnetic field across the fluid in one or other set of passages. However, this approach requires two independent magnetic circuits, and makes the design of the unit more complex but it removes the need for the coil switching to be synchronised with the crankshaft rotation directly.

The invention claimed is:

1. A phase shifting mechanism for an engine camshaft that is subjected to torque fluctuations during operation, the mechanism comprising a drive member and a driven member coupled for rotation with one another by means of a closed hydraulic circuit formed of a plurality of variable volume working chambers that are connected to one another in such a manner that the volume of one increases as the volume of another decreases, flow of fluid between the working chambers causing the phase of the drive member to be shifted relative to the driven member, characterised in that the chambers are filled with a magnetorheological fluid and are connected to one another through passages along which fluid flow is controlled by the selective application of a magnetic field.

2. A phase shifting mechanism as claimed in claim 1, wherein the working chambers are defined between radial vanes movable in arcuate cavities.

3. A phase shifting mechanism as claimed in claim 2, comprising two diametrically opposed arcuate cavities that rotate with one of the drive and driven members, each being divided into two working chambers by a respective one of two radial vanes rotatable with the other of the two members.

4. A phase shifting mechanism as claimed in claim 1, wherein two magnetic circuits, each including a one-way valve, are provided for advancing and retarding the timing, respectively.

5. A phase shifting mechanism for an engine camshaft that is subjected to torque fluctuations during operation, the mechanism comprising a drive member and a driven member coupled for rotation with one another by means of a closed hydraulic circuit formed of a plurality of variable volume working chambers that are connected to one another in such a manner that the volume of one increases as the volume of another decreases, flow of fluid between the working chambers causing the phase of the drive member to be shifted relative to the driven member, characterised in that the chambers are filled with a magnetorheological fluid and are connected to one another through passages along which fluid flow is controlled by the selective application of a magnetic field, wherein a single flow path is provided between each pair of interconnected working chambers and an electromagnet is provided to apply to the fluid flowing along the flow path a magnetic field of modulated amplitude, the modulation having a frequency related to the speed of rotation of the camshaft and having a phase dependent upon the sense in which the relative phase of the drive and driven members is to be varied.

6. A phase shifting mechanism as claimed in claim 5, wherein the electromagnet is stationarily mounted when in use and the magnetic circuit of the electromagnet traverses the fluid path.

* * * * *